United States Patent [19]

Kubo et al.

[11] 4,437,883

[45] Mar. 20, 1984

[54] PROCESS FOR PRODUCING METAL POWDER

[75] Inventors: Toshihiko Kubo, Namekata; Minoru Ichidate, Otsu; Toshiyuki Kawai, Nishinomiya; Sadao Yonehara, Katano; Yoshihisa Koiwai; Kazuhiko Endo, both of Yokohama, all of Japan

[73] Assignees: Sumitomo Metal Industries, Ltd., Osaka; Nippon Oil Co. Ltd., Tokyo, both of Japan

[21] Appl. No.: 466,317

[22] Filed: Feb. 14, 1983

[30] Foreign Application Priority Data

Feb. 12, 1982 [JP] Japan ..... 57-21818

[51] Int. Cl.[3] ..... B22F 9/08

[52] U.S. Cl. ..... 75/0.5 C; 264/7; 264/11; 264/12; 75/0.5 R

[58] Field of Search ..... 75/0.5 C, 0.5 R; 264/7, 264/11, 12; 148/126

[56] References Cited

U.S. PATENT DOCUMENTS

| | | | |
|---|---|---|---|
| 2,273,573 | 2/1942 | Hasche | 264/11 |
| 4,124,377 | 11/1978 | Larson | 75/0.5 C |
| 4,152,138 | 5/1979 | Ripley et al. | 75/0.5 C |
| 4,385,929 | 5/1983 | Ichidate et al. | 75/0.5 C |
| 4,391,772 | 7/1983 | Bonnor et al. | 75/0.5 C |

FOREIGN PATENT DOCUMENTS

| | | | |
|---|---|---|---|
| 9433 | 4/1980 | European Pat. Off. | 75/0.5 C |

*Primary Examiner*—Veronica O'Keefe

*Attorney, Agent, or Firm*—Fisher, Christen & Sabol

[57] ABSTRACT

Metal powder having low oxygen and carbon contents and suitable for powder metallurgy may be obtained by using, as an atomizing medium, a special composition containing an alcohol having 1–4 carbon atoms and water as its essential components when impinging the atomizing medium against a molten metal in a state isolated from the ambient air to produce the metal powder.

8 Claims, 2 Drawing Figures

PROCESS FOR PRODUCING METAL POWDER

BACKGROUND OF THE INVENTION

1. Field of the Invention

This invention relates to a process for producing metal powder particularly with low oxidation and having a desired carbon content from a molten metal by virtue of the atomization method.

2. Description of the Prior Art

The production method of metal powder by the atomizing technique may be divided roughly into the gas-atomization method in which a gas is used as an atomizing medium and the water atomization method in which water is employed as an atomizing medium. The former method has the merit that, owing to the use of an inert gas or reducing gas, less oxidized metal powder may be obtained. However, due to the small cooling capacity of a gas, the cooling of powdered metal takes place slowly and powder particles may thus be prilled into spheres in the course of their cooling under the influence of surface tensions. Spherical powder is poor in mechanical strength after pressing and sintering, and is thus not preferred as a starting material for powder metallurgical products.

On the other hand, the water-atomization method features a high cooling speed and powdered metal particles have good sinterability and non-uniform shapes. Such powdered metal particles however require a reduction treatment prior to their use because they have been oxidized by oxygen contained in water or generated by the decomposition of water. The reduction treatment is carried out, mainly, by using hydrogen gas. However, equipment for the reduction treatment is expensive and the operation cost thereof is enormous, leading to the drawback that the prices of powdered products will become higher.

As a method capable of solving the above-described drawback of the water-atomization method, has been developed an atomization method using an oil or the like as the atomizing medium, namely, the so-called oil-atomization method. According to this method, the oxidation of metal powder, which takes place during its atomizing period, can be prevented almost completely. However, the oil-atomization method generally requires a decarburization treatment since oils are decomposed upon contact with a molten metal of a high temperature during their atomization and the carburization of metal powder takes place, thereby generally making a decarburization treatment necessary.

As described above, conventional atomization methods using a gas or liquid as an atomizing medium are accompanied by various problems.

SUMMARY OF THE INVENTION

An object of this invention is to provide a process for producing of metal powder of uniform quality and suitable for powder metallurgy by effectively retarding its oxidation and carburization.

Another object of this invention is to provide a process for the production of metal powder having high quality and low oxygen and carbon contents without need for any subsequent reduction or decarburization treatment.

A further object of this invention is to provide a novel atomizing medium composition suitable for use in the production of metal powder by the atomization method.

The above-described objects of this invention may be attained by a method for producing metal powder by impinging an atomizing medium against a molten metal in a state isolated from the ambient air, characterized in that said atomizing medium contains as its essential components an alcohol having 1–4 carbon atoms and water and the weight ratio of said alcohol to water is within the range of 2–70:98–30.

DETAILED DESCRIPTION OF THE PREFERRED EMBODIMENTS

Figure 1:
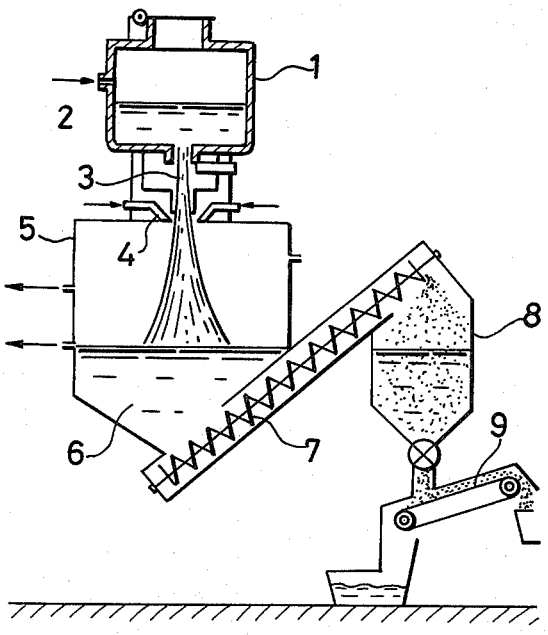
FIG. 1 is a schematic illustration showing one example of the apparatus useful for the production of metal powder in accordance with the method of this invention.

First of all, a brief description will be made, by way of example, on the practice of the production method of metal powder in accordance with this invention, using the apparatus shown in FIG. 1.

In the drawing, 1 is a reservoir for storing a molten metal 2 therein. 4 and 5 indicate, respectively, a nozzle for impinging an atomizing medium and an atomizing tank. 7 indicates a classifier, whereas 8 and 9 are a hopper and conveyer, respectively. The reservoir 1, atomizing tank 5 and the part coupling the reservoir 1 and tank 5 together are isolated from the ambient air. Their interiors are maintained at a pressure above the atmospheric pressure with an inert gas.

Operation of the above facilities will next be described. The molten metal 2 stored in the reservoir 1 is caused to flow down through a bottom part of the reservoir 1 into the atomizing tank 5. In the course of the downward flow of the molten metal 2, a mixed atomizing medium of the alcohol and water is impinged through the nozzle 4 against a molten metal stream flow 3. The thus-formed metal powder is then cooled by a cooling medium (usually, the same liquid as the atomizing medium) in the atomizing tank 5. Thereafter, the resultant metal powder is taken out of the tank 5 by means of the classifier 7 and stored in the hopper 8. After removing a part of the accompanying atomizing medium in the hopper 8, the metal powder is further delivered by the conveyer 9 to a drying apparatus in which it is dried to a final metal powder product.

The method of this invention may be applied to a variety of metals which can be formed into powder from their molten states. As exemplary metals may be mentioned metals such as Mg, Al, Fe, Ni, Cu, Zn, Ag, Cd, Sn, Pb, Co, Cr, Mn, Mo, Si and B; alloys made of two or more of the above-mentioned specific metals; and metal mixtures formed of one or more of the above-mentioned specific metals and one or more non-metallic elements mixed therewith. The method of this invention may be particularly useful when applied to molten iron, plain carbon steel or alloy steel.

As exemplary alcohols having 1–4 carbon atoms which are useful in the practice of this invention may be mentioned methanol, ethanol, n-propanol, iso-propanol, n-butanol, iso-butanol, sec-butanol and tert-butanol as well as mixtures of two or more of such specific alcohols. Particularly, methanol, ethanol and iso-propanol may be used as preferable alcohols, either singly or in combination.

The method of this invention makes use of a mixture of an alcohol and water as the atomizing medium for the production of metal powder, because the alcohol serves as an oxidation inhibitor against oxidation of metal powder by the water while the water acts as a carburization inhibitor against carburization of metal powder by the alcohol. Accordingly, use of a mixture of an alcohol and water as the atomizing medium can almost completely avoid the oxidation and carburization of metal powder to be produced owing to the mutually-compensating inhibitory actions of the alcohol and water, thereby providing metal powder of good quality.

In the present invention, the ratio of the alcohol to water, both essential components, is limited to the range of 2–70:98–30 by weight for the following reasons.

Figure 2:
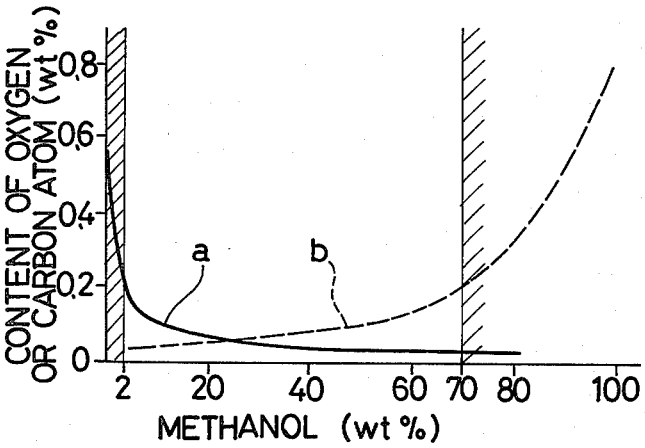
FIG. 2 is a graph showing the relationship between the oxygen and carbon contents of atomized metal powder versus the composition of mixed alcohol (methanol)/water atomizing medium in the production of iron powder by the atomization method.

The graph of FIG. 2 was prepared on the basis of the result of an investigation of the contents of oxygen and carbon in iron powder as a function of the ratio of the alcohol to water in the atomizing medium. Namely, FIG. 2 is a graph of the average values of both oxygen and carbon contents in resultant metal powder when the mixing ratio of the alcohol (methanol) to water, which are components of the atomizing medium, were changed in various ways from one charge of a molten steel to another charge of the molten steel. In the drawing, a indicates the oxygen content while b indicates the carbon content. An analysis result on the components of the used molten steel other than iron, the specification of the atomizing apparatus and the operating conditions of the atomizing method are given in Tables 1, 2 and 3, respectively.

TABLE 1

| | Components of Molten Iron | | | | | |
|---|---|---|---|---|---|---|
| Components | C | Si | Mn | P | S | O |
| Wt. % | 0.01 | <0.01 | <0.01 | 0.006 | 0.003 | 0.035 |

TABLE 2

| Specification of Atomization Apparatus | | | |
|---|---|---|---|
| Process | Apparatus | | Specification |
| Powdering process | Molten iron reservoir | Internal capacity | 3900 $cm^3$ |
| | | Diameter of sprue for molten iron | 10 mm $\phi$ |
| | Atomizing nozzle | Type | Ring-shaped |
| | | Diameter of injection nozzle for molten iron | 30 mm $\phi$ |

TABLE 3

| Operating Conditions | |
|---|---|
| Parameter | Condition |
| Temperature of molten iron | 1700° C. |
| Weight of molten iron | 20 kg/charge |
| Atomizing pressure | 150 $kg/cm^2$ |
| Volume of atomizing medium | 250 l/min. |

From the results shown in FIG. 2, it has been found that the weight ratio of the alcohol to water in an atomizing medium must be limited to the range of 2–70:98–30 in order to control the oxygen and carbon contents of metal powder below 0.2 wt.% which is the minimum requirement for permitting use of the metal powder as a raw material for powder metallurgical products.

It has also been envisaged that the weight ratio of the alcohol to water in an atomizing medium must be limited to the range of 10–60:90–40 where metal powder having an oxygen and carbon content of 0.1 wt.% or less is desired.

The alcohol and water, both being essential components of the atomizing medium, may be used by mixing them together either in advance or immediately before impinging the resulting atomizing medium. The thus-prepared mixed atomizing medium of alcohol and water is preferably in the form of a uniform solution. However, it may be in such a state that one of the components is dispersed as fine droplets in the other component (for instance, in an emulsified state) depending on the mixing ratio of the components.

Furthermore, it may be possible to add, to a mixture of an alcohol and water, a rust preventive such as an alkanol amine (e.g., triethanol amine), sodium nitrite, an alkali metal salt of boric acid or an alkali metal salt of phosphoric acid; and/or a corrosion preventive such as a triazine derivative [e.g., hexahydro-1,3,5-tris(2-hydroxyethyl)-S-triazine], a tertiary ammonium salt (e.g., benzyl-dimethyl-alkylammonium) or the like. In this case, it is desirous to add the rust preventive in an amount below 5 wt.% and the corrosion preventive in an amount below 1 wt.%.

The above method is effective to obtain metal powder having oxygen and carbon contents, individually, of 0.1 wt.% or less. It may, however, be necessary, depending on the type of steel, to anneal and soften the thus-obtained metal powder so as to improve its formability where the metal powder is to be used for powder metallurgy.

Even if metal powder having still lower oxygen or carbon content, namely, an extremely low oxygen or carbon content is desired, such metal powder may be obtained with relative ease by subjecting metal powder obtained in accordance with the above method to a further reduction or decarburization treatment.

Examples of the present invention will next be described.

EXAMPLE 1

Using the apparatus shown in FIG. 1, steel powder was produced from a molten steel having the components given in Table 4. The composition of each steel powder produced is shown together with the composition of its corresponding atomizing medium in Table 5. The specification of the apparatus and its operating conditions were the same as those shown in Tables 2 and 3. In the present Example, methanol in an amount corresponding to each composition shown in Table 5 was added to water placed in a mixing vessel while agitating the water. The methanol and water were used as the atomizing medium after they had been converted into a uniform mixture. In addition, Table 5 also contains results of two Comparative Examples, one using an atomizing medium consisting solely of methanol and the other employing an atomizing medium made of water only.

As is apparent from Table 5, the oxygen and carbon contents of steel powder produced using each of the atomizing media according to this invention were below 0.10 wt.% and 0.20 wt.%, respectively. Compared with the steel powder of Test No. 7, a Comparative Example in which an atomizing medium consisting solely of methanol was used, the carburization of the steel powder produced using each of the atomizing media according to this invention was considerably suppressed. Similarly, the oxidation of the steel powder produced using each of the atomizing media according to this invention was also retarded compared with the steel powder of Test No. 8, a Comparative Example in which an atomizing medium made of water only was used.

TABLE 4

| Components | Components of Molten Steel C | Si | Mn | P | S | O |
|---|---|---|---|---|---|---|
| Wt. % | 0.006 | 0.01 | 0.83 | 0.007 | 0.004 | 0.0057 |

TABLE 5

| | Test No. | Composition of Atomizing Medium and Chemical Composition of Steel Powder: Composition of atomizing medium (wt. %) Methanol | Water | Rust preventive[1] | Corrosion preventive[2] | Chemical composition of steel powder (wt. %) C | Si | Mn | P | S | O |
|---|---|---|---|---|---|---|---|---|---|---|---|
| Examples (this invention) | 1 | 70 | 30 | — | — | 0.20 | <0.01 | 0.83 | 0.007 | 0.004 | <0.05 |
| | 2 | 50 | 50 | — | — | 0.10 | <0.01 | 0.83 | 0.007 | 0.004 | <0.05 |
| | 3 | 30 | 70 | — | — | 0.08 | <0.01 | 0.83 | 0.007 | 0.004 | <0.05 |
| | 4 | 10 | 90 | — | — | 0.05 | <0.01 | 0.83 | 0.007 | 0.004 | 0.10 |
| | 5 | 10 | 85 | 4.5 | 0.5 | 0.05 | <0.01 | 0.83 | 0.007 | 0.004 | 0.08 |
| | 6 | 15 | 80 | 4 | 1 | 0.06 | <0.01 | 0.83 | 0.007 | 0.004 | 0.09 |
| Comp. Examples | 7 | 100 | 0 | — | — | 0.58 | <0.01 | 0.83 | 0.007 | 0.004 | <0.05 |
| | 8 | 0 | 100 | — | — | 0.005 | <0.01 | 0.80 | 0.007 | 0.004 | 0.60 |

Note:
[1]Triethanol amine
[2]Hexahydro-1,3,5-tris(2-hydroxyethyl)-S—triazine

EXAMPLE 2

Steel powder samples were produced using mixtures of isopropanol and water as atomizing media and the same apparatus and operating conditions as those employed in Example 1. The components of the molten steel used is shown in Table 6. The composition of each atomizing medium and of the resulting steel powder are given in Table 7.

As is apparent from Table 7, the oxygen and carbon content of each steel powder sample were 0.09 wt.% or less and 0.11 wt.% or less, respectively. Thus, the use of isopropanol as the alcohol has been found effective for the retardation of oxidation and carburization of steel powder during its atomizing treatment.

TABLE 6

| Components | Components of Molten Steel C | Si | Mo | P | S | O |
|---|---|---|---|---|---|---|
| Wt. % | 0.008 | 0.01 | 0.30 | 0.005 | 0.004 | 0.003 |

TABLE 7

| | Test No. | Composition of Atomizing Medium and Chemical Composition of Steel Powder: Composition of atomizing medium (wt. %) Isopropanol | Water | Rust preventive[1] | Corrosion preventive[2] | Chemical composition of steel powder (wt. %) C | Si | Mn | P | S | O |
|---|---|---|---|---|---|---|---|---|---|---|---|
| Examples (this invention) | 9 | 70 | 30 | — | — | 0.11 | <0.01 | 0.30 | 0.005 | 0.004 | <0.05 |
| | 10 | 50 | 50 | — | — | 0.05 | <0.01 | 0.30 | 0.005 | 0.004 | 0.05 |
| | 11 | 30 | 70 | — | — | <0.05 | <0.01 | 0.30 | 0.005 | 0.004 | 0.05 |
| | 12 | 10 | 90 | — | — | <0.05 | <0.01 | 0.30 | 0.005 | 0.004 | 0.09 |
| | 13 | 10 | 85 | 5 | — | <0.05 | <0.01 | 0.30 | 0.005 | 0.004 | 0.08 |
| | 14 | 10 | 84.9 | 5 | 0.1 | <0.05 | <0.01 | 0.30 | 0.005 | 0.004 | 0.08 |
| Comp. Examples | 15 | 100 | 0 | — | — | 0.42 | <0.01 | 0.30 | 0.005 | 0.004 | 0.05 |
| | 16 | 0 | 100 | — | — | 0.005 | <0.01 | 0.28 | 0.005 | 0.004 | 0.60 |

Note:
[1]Sodium nitrite
[2]Benzyl-dimethyl-alkyl-ammonium

As has been described above, use of the atomizing medium according to this invention can provide high quality metal powder having low oxygen and carbon contents because it is capable of effectively retarding the oxidation and carburization of powder in the course of the atomization process. In addition, it is possible, depending upon the exact oxygen and carbon limits desired in the powder produced, to avoid the further processing step of subjecting the resultant metal powder to a reducing treatment or decarburization treatment subsequent to its atomization, thereby possibly leading to a reduction in its production cost.

What is claimed is:

1. A process for producing metal powder by impinging an atomizing medium against a molten metal in a state isolated from the ambient air, said atomizing medium consist essentially of an alcohol having 1–4 carbon atoms and water and the weight ratio of said alcohol to water is within the range of 2–70:98–30.

2. A process for producing metal powder by impinging an atomizing medium against a molten metal in a state isolated from the ambient air, said atomizing medium consists essentially of an alcohol having 1–4 carbon atoms and water and the weight ratio of said alcohol to water is within the range of 2–70:98–30, and said process further comprises, subsequent to the powdering of said molten metal by said atomizing medium, subjecting the resultant metal powder to a treatment selected from the group consisting of a heat treatment, decarburization treatment and reduction treatment.

3. A process as claimed in claim 1, wherein the metal subjected to the powdering method is a metal selected from the group consisting of Mg, Al, Fe, Ni, Cu, Zn, Ag, Cd, Sn, Pb, Co, Cr, Mn, Mo, Si and B, or an alloy made of one or more metals selected from the group.

4. A process as claimed in claim 2, wherein the metal subjected to the powdering method is a metal selected from the group consisting of Mg, Al, Fe, Ni, Cu, Zn, Ag, Cd, Sn, Pb, Co, Cr, Mn, Mo, Si and B, or an alloy made of one or more metals selected from the group.

5. A process as claimed in claim 3 or 4, wherein the metal subjected to the atomization method is iron, plain carbon steel or alloy steel.

6. A process as claimed in claim 1 and 2, wherein the alcohol is selected from the group consisting of methanol, ethanol, iso-propanol and a mixture thereof.

7. A process as claimed in claim 1 or 2, wherein the weight ratio of said alcohol to water is within the range of 10–60:90–40.

8. A process as claimed in claim 1 or 2, wherein the atomizing medium additionally contains an additive selected from the group consisting of rust preventive, a corrosion preventive and a mixture thereof.

* * * * *